US006769543B2

(12) United States Patent
Hsu

(10) Patent No.: US 6,769,543 B2
(45) Date of Patent: Aug. 3, 2004

(54) STEREOSCOPIC INNER SPACER

(75) Inventor: Fong-Ling Hsu, Pa Te (TW)

(73) Assignee: Quanta Computer Inc., Taoyuan Hsien (TW)

( * ) Notice: Subject to any disclaimer, the term of this patent is extended or adjusted under 35 U.S.C. 154(b) by 81 days.

(21) Appl. No.: 10/252,098

(22) Filed: Sep. 23, 2002

(65) Prior Publication Data

US 2004/0000500 A1 Jan. 1, 2004

(30) Foreign Application Priority Data

Jun. 28, 2002 (TW) ..... 91209872 U

(51) Int. Cl.[7] ..... B65D 73/00

(52) U.S. Cl. ..... 206/486; 206/775

(58) Field of Search ..... 206/486, 487, 206/359, 395, 396, 775, 776, 779, 781, 783; 229/120.11, 120.13, 120.14, 120.15, 120.18, 120.29

(56) References Cited

U.S. PATENT DOCUMENTS

| | | | | | |
|---|---|---|---|---|---|
| 3,489,269 | A | * | 1/1970 | Rosenberg | 206/783 |
| 3,712,461 | A | * | 1/1973 | Schillinger | 206/277 |
| 4,121,752 | A | * | 10/1978 | Ravotto et al. | 206/486 |
| RE33,503 | E | * | 12/1990 | Schluger | 206/459 |
| 5,289,917 | A | * | 3/1994 | Chabria | 206/232 |

* cited by examiner

*Primary Examiner*—Shian T. Luong
(74) *Attorney, Agent, or Firm*—Hoffman, Wasson & Gitler, PC

(57) ABSTRACT

A stereoscopic inner spacer is disclosed. The stereoscopic inner spacer with a new structure is made from folding and crossing paper material for supporting and holding an object securely in a packaging carton and protecting the object from impacts. The stereoscopic inner spacer of the present creation substitutes the prior art that has to develop and manufacture a mold, saves the cost of developing the mold, but also improves insufficient anti-shocking ability of the inner spacer made by folding and gluing paperboards. The present creation is not required to glue together by an adhesive, and meets the trend of environmental protection.

12 Claims, 3 Drawing Sheets

STEREOSCOPIC INNER SPACER

FIELD OF THE INVENTION

The present invention relates to a stereoscopic inner spacer, and more particularly, to a stereoscopic inner spacer used to support and hold an object securely in a packaging carton, thereby protecting the object from impacts, and the application of the stereoscopic inner spacer is not limited to the present field.

BACKGROUND OF THE INVENTION

Protective packaging structures are used for supporting objects deposited within the packaging structures to protect the objects from impacts, water, and shaking. Generally, the materials forming the protective packaging structures are often selected from papers, plastics, and metals. Due to the advantages of easy printing and fabricating, and low technique threshold and cost, the protective packaging structures made of paper are widely applied in various aspects of daily life. However, the impact-resistibility and water-resistibility of the paper packing structures are insufficient during loading, transporting, and unloading. Particularly, while transporting the computers and related devices thereof, dust-proof, anti-pollution, and shockproof are needed even more, therefore, additional inner spacer, papers or plastics lining materials, foamed plastic filler, or foamed cushioning pad are added to protect the objects within the packaging structures from shaking.

Recently, with the promoting of the environmental protection awakening, the inner spacer made of paper has advantages of low cost of fabricating, storing, and transporting; being able to be made by using primitive paper pulp or reprocessed paper pulp; and good performance of printing, and especially the other materials need to bear the cost of recycle lately, so that the paper inner spacer has more powerful competitiveness. The formation of the paper inner spacer can be performed mainly in two methods: The first method is to form the paper inner spacer by directly hot pressing paper pulp into a mold, and the second method is to design and cut paper sheets to form various different inner spacers. The second method is performed first by sampling and drawing parallel lines according to the size of the required object, and then by folding and pasting according to the required style so as to fabricate the inner spacer required.

However, the method of forming the paper inner spacer by directly hot pressing paper pulp into a mold needs to develop and fabricate the mold, so that the cost is increased due to the expense of fabricating the mold, and additionally, the inner spacer made by folding and pasting paper sheets has the drawbacks of poor impact-resistibility and needing to use adhesive. Therefore, it is necessary to provide a better stereoscopic inner spacer to support and hold objects securely deposited in a packaging carton for protecting the objects from impacts.

SUMMARY OF THE INVENTION

In view of the drawbacks of the conventional technique, therefore, one major object of the present invention is to provide a stereoscopic inner spacer made by folding and crossing paper materials to form the new structure of stereoscopic inner spacer to support and hold objects securely deposited within a packaging carton, thereby protecting the objects from impacts. Comparing to the conventional techniques, the present invention, does not need to develop and fabricate molds thereby saving the cost of making the molds; avoids the poor impact-resistibility of the inner spacer made by folding and pasting paper sheets; and does not need to use adhesive.

The other object of the present invention is to provide a stereoscopic inner spacer, which is formed by folding and crossing paper materials for supporting and holding objects deposited securely within a packaging carton. The stereoscopic inner spacer of the present invention is fabricated without using adhesive, and conforms to the environmental protection standards widely adopted in Taiwan, Europe, America, Japan, and China, etc., recently.

According to the aforementioned objects, the present invention further provides a stereoscopic inner spacer used to support and hold an object securely in a packaging carton, and the stereoscopic inner spacer comprises:

an upper panel, wherein the upper panel includes relatively a left side portion, a right side portion, and a rear side portion, and a first fold line is formed on the borders of the upper panel respectively adjacent to the left side portion, the right side portion, and the rear side portion, and the upper panel is segmented to form a plurality of inserting slices used to form an open space;

the left side portion includes a left side panel, a first front reinforced slice, and a first rear reinforced slice, and the first fold line is formed between the left side panel and the upper panel, wherein a second fold line is formed between the first front reinforced slice and the left side panel, and a first groove is implemented on the appropriate position of the first front reinforced slice; and a third fold line is formed between the first rear reinforced slice and the left side panel, and a second groove is implemented on the appropriate position of the first rear reinforced slice;

the right side portion includes a right side panel, a second front reinforced slice, and a second rear reinforced slice, and the first fold line is formed between the right side panel and the upper panel, wherein the second fold line is formed between the second front reinforced slice and the right side panel, and a third groove is implemented on the second front reinforced slice; and the third fold line is formed between the second rear reinforced slice and the right side panel, and a fourth groove is implemented on the second rear reinforced slice, by folding the first fold line and the second fold line and crossing the first groove and the second groove, and folding the third fold line and crossing the third groove and the fourth groove to form a hollow rectangle cuboid; and the rear side portion includes a rear side panel, a bottom panel, and a rear connecting portion, and the first fold line is formed between the rear side panel and the upper panel, wherein a fifth fold line is formed between the bottom panel and the rear side panel, and a plurality of inserted sockets corresponding to the inserting slices are formed on the bottom panel, so as to plug the inserting slices into the inserted sockets correspondingly, thereby forming the open space; and a sixth fold line is formed between the rear connecting portion and the bottom panel.

According to the stereoscopic inner spacer of the present invention, the present invention further comprises: folding the first fold line of the rear side panel and the fifth fold line of the bottom panel, so as to make the bottom panel cross the first and second rear reinforced slices that are mutually crossed; and folding the rear connecting portion backwards to make the rear connecting portion parallel to a side of the first and second front reinforced slices that are mutually crossed, wherein the first and second rear reinforced slices mutually crossed are used to support the bottom panel.

Because the stereoscopic inner spacer of the present invention is fabricated by folding and crossing paper materials, comparing to the conventional techniques, the present invention, does not need to develop and fabricate molds thereby saving the cost of making the molds; avoids the poor impact-resistibility of the inner spacer made by folding and pasting paper sheets; and does not need to use adhesive.

Furthermore, the stereoscopic inner spacer of the present invention is fabricated by folding and crossing paper materials to support and hold objects securely deposited within a packaging carton. Therefore, the stereoscopic inner spacer of the present invention is easier to fabricate without using adhesive, and conforms to the environmental protection requirements.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention provides a stereoscopic inner spacer made by folding and crossing paper materials to support and hold objects securely deposited within a packaging carton, thereby protecting the objects from impacts. The following description is an embodiment of achieving the stereoscopic inner spacer and the sizes of all portions of the stereoscopic inner spacer according to the present invention, and is merely stated as an illustration for explaining the present invention rather than as a limitation of the present invention.

Figure 1:
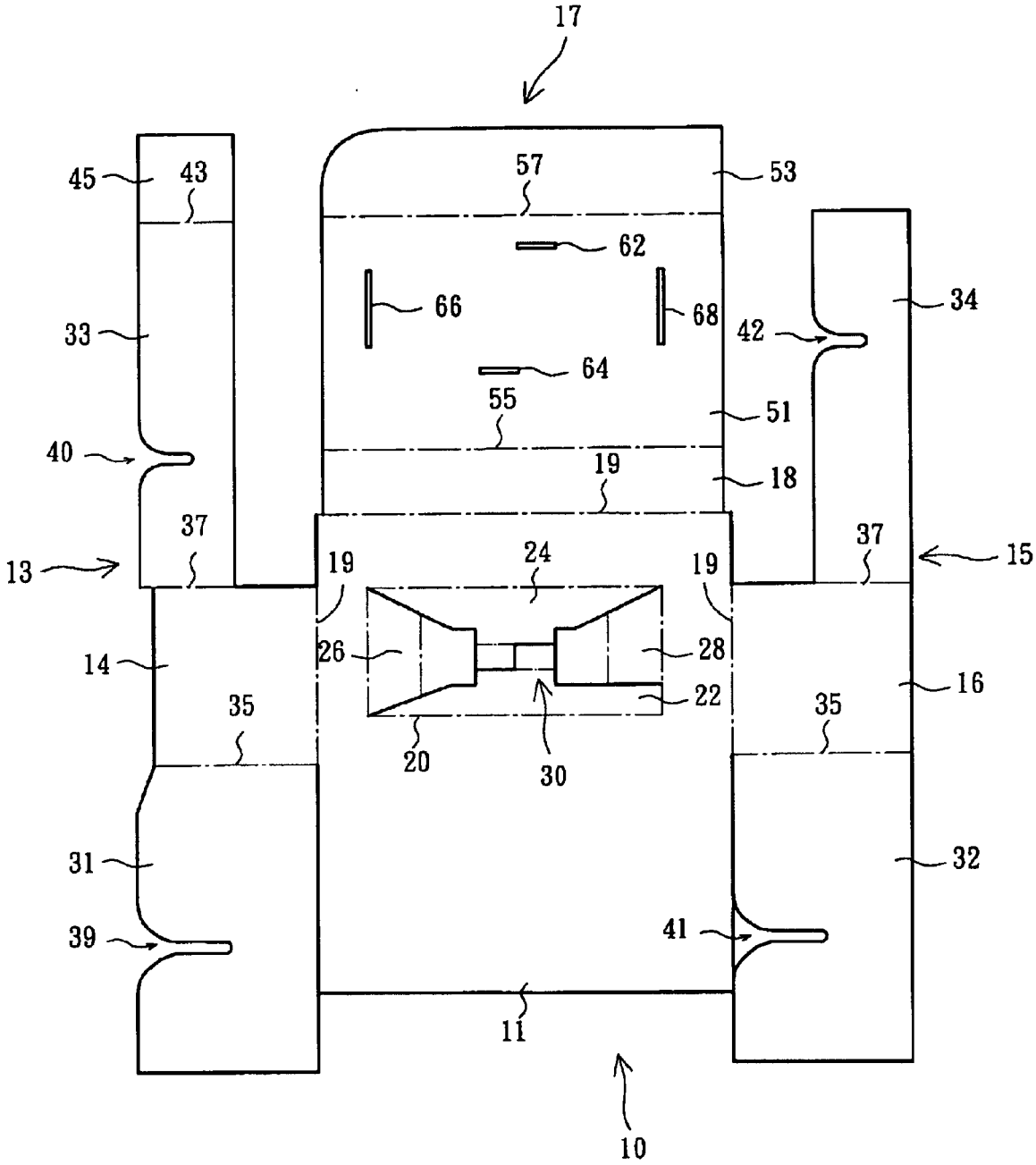
FIG. 1 illustrates a diagram showing an unfolded stereoscopic inner spacer of the present invention.

Referring to FIG. 1, FIG. 1 illustrates a diagram showing an unfolded stereoscopic inner spacer of the present invention. The stereoscopic inner spacer 10 of the present invention is used to support and hold objects securely deposited within a packaging carton. The material of the stereoscopic inner spacer 10 is preferably selected from a paper material having a buffer layer in the middle, and the specific examples related to the material are corrugated paper and bond paper, etc. The stereoscopic inner spacer 10 comprises: an upper panel 11, wherein the upper panel 11 includes relatively a left side portion 13, a right side portion 15, and a rear side portion 17, and a fold line 19 is formed on the borders of the upper panel 11 respectively adjacent to the left side portion 13, the right side portion 15, and the rear side portion 17. The left side portion 13 and the right side portion 15 are disposed on the opposite sides of the upper panel 11, and the rear side portion 17 is disposed between the left side portion 13 and the right side portion 15. The size of the upper panel 11 depends on the internal size of a carton body 110 of a packaging carton 100 (shown in FIG. 3), and a rectangle 20 is defined on the upper panel 11, wherein the size of the rectangle 20 depends on the object deposited thereon, and the rectangle 20 is segmented to form an inserting slice 22, an inserting slice 24, an inserting slice 26, and an inserting slice 28, thereby forming an open space 30 to deposit a component (such as a computer device) that is smaller than the packaging carton 100.

The left side portion 13 includes a left side panel 14, a front reinforced slice 31, and a rear reinforced slice 33, wherein a fold line 19 is formed between the left side panel 14 and the upper panel 11; a fold line 35 is formed between the front reinforced slice 31 and the left side panel 14; and a groove 39 is implemented on the appropriate place on the front reinforced slice 31. A fold line 37 is formed between the rear reinforced slice 33 and the left side panel 14, and a groove 40 is implemented on the appropriate position of the rear reinforced slice 33. Besides, the left side portion 13 further has a left extending portion 45, wherein a fold line 43 is formed between the left extending portion 45 and the rear reinforced slice 33.

The right side portion 15 includes a right side panel 16, a front reinforced slice 32, and a rear reinforced slice 34, wherein the fold line 19 is formed between the right side panel 16 and the upper panel 11; the fold line 35 is formed between the front reinforced slice 32 and the right side panel 16; and a groove 41 is implemented on the appropriate position of the front reinforced slice 32. The fold line 37 is formed between the rear reinforced slice 34 and the right side panel 16, and a groove 42 is implemented on the appropriate position of the rear reinforced slice 34.

A feature of the present invention is to connect the front reinforced slice 31 and the front reinforced slice 32, and to connect the rear reinforced slice 33 and the rear reinforced slice 34 by folding the fold line 19 and the fold line 35; crossing the groove 39 and the groove 41; folding the fold line 37; and crossing the groove 40 and the groove 42, so as to form a hollow rectangle cuboid. The hollow rectangle cuboid not only is used to support the bottom panel 51, but also has a better impact-resistibility, thereby providing a better cushioning effect. For example, a stereoscopic inner spacer of a preferred embodiment of the present invention can sustain an impact caused by the 50-grams stereoscopic inner spacer falling from a height of 90 centimeters with a velocity of 11 meters per second.

Figure 3:
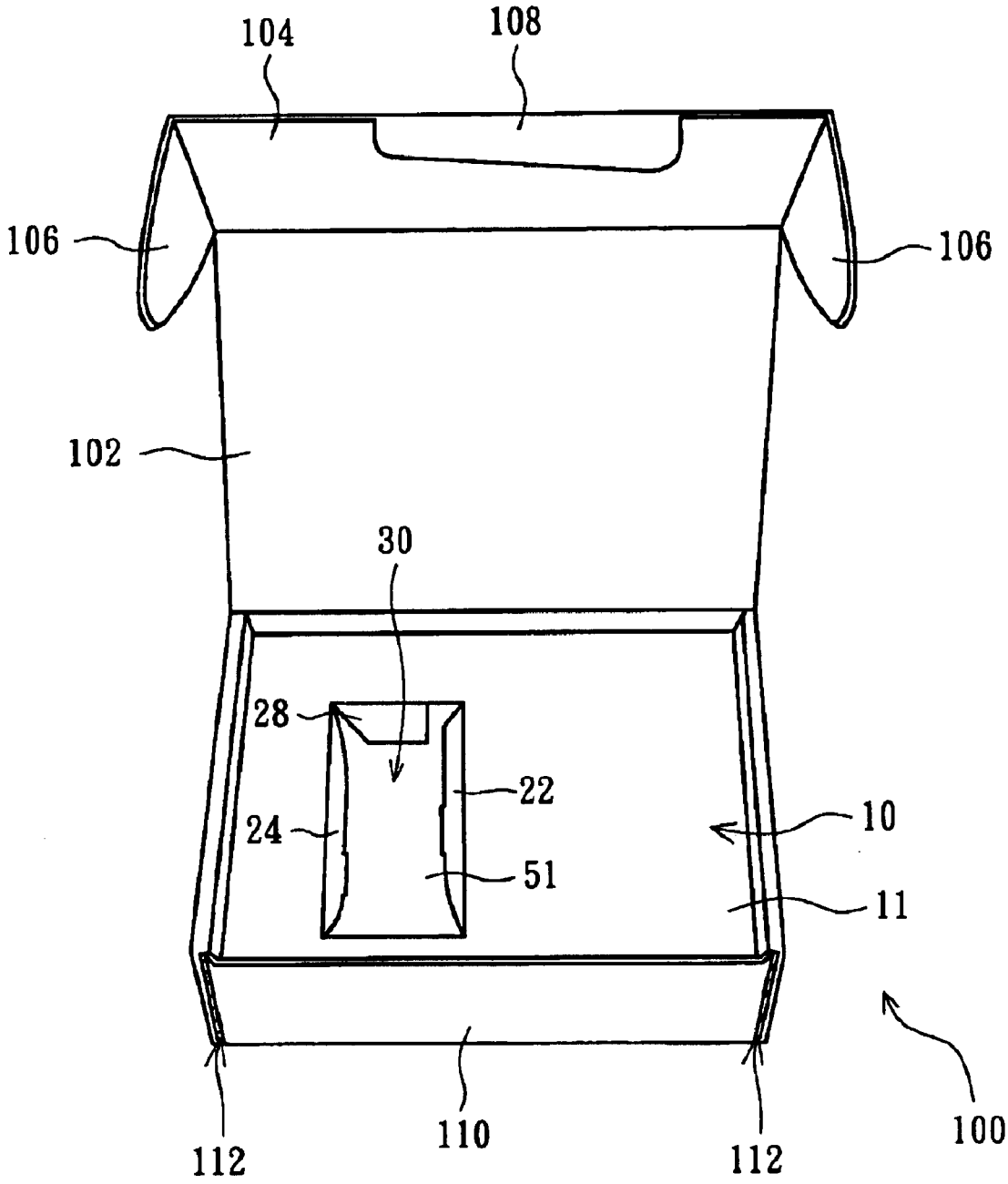
FIG. 3 illustrates a 3-D diagram showing a stereoscopic inner spacer of the present invention deposited within a packaging carton.

Because the groove 39 and the groove 41 are used to cross the front reinforced slice 31 and the front reinforced slice 32, and the groove 40 and the groove 42 are used to cross the rear reinforced slice 33 and the rear reinforced slice 34, therefore, another feature of the present invention is that the directions of the groove 39, the groove 40, the groove 41, and the groove 42 are not limited. For example, the groove 39, the groove 40, the groove 41, and the groove 42 in FIG. 3 are all open to the left, but the groove 39, the groove 40, the groove 41, and the groove 42 of the stereoscopic inner spacer of the present invention can also be open to the right.

Figure 2:
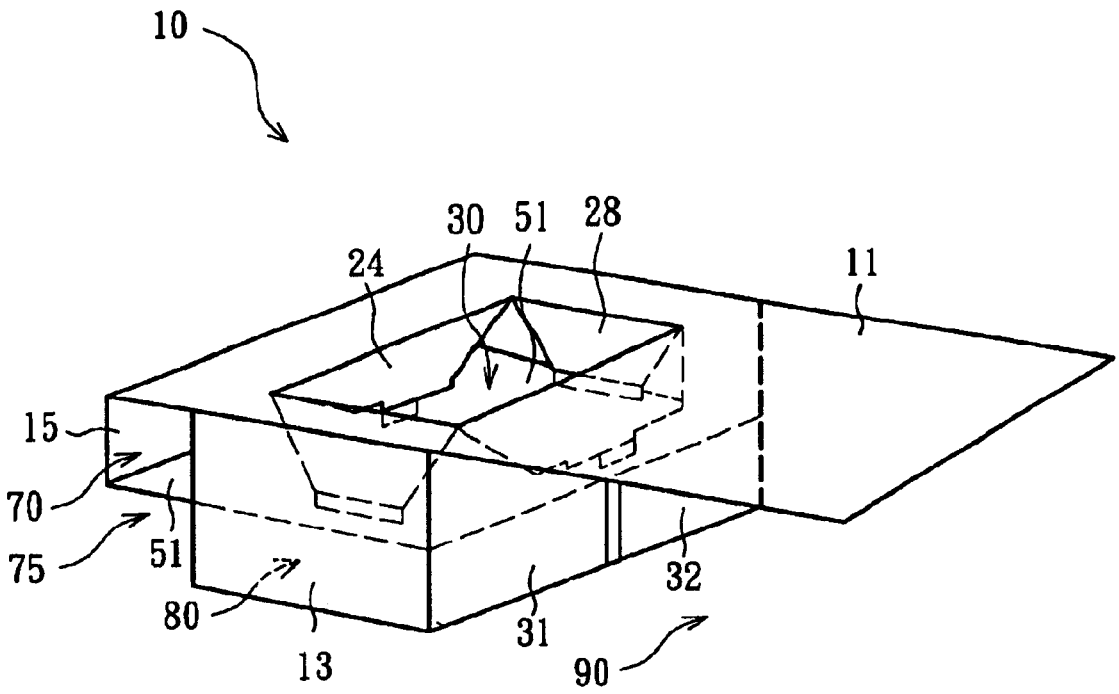
FIG. 2 illustrates a 3-D assembly diagram showing a stereoscopic inner spacer of the present invention.

The rear side portion 17 includes a rear side panel 18, a bottom panel 51, and a rear connecting portion 53, wherein a fold line 55 is formed between the bottom panel 51 and the rear side panel 18; and an inserted socket 62, an inserted socket 64, an inserted socket 66, and an inserted socket 68 corresponding to the inserting slice 22, the inserting slice 24, the inserting slice 26, and the inserting slice 28 are formed on the bottom panel 51, so as to plug the inserting slice 22, the inserting slice 24, the inserting slice 26, and the inserting slice 28 into the inserted socket 62, the inserted socket 64, the inserted socket 66, and the inserted socket 68 correspondingly, thereby forming the open space 30 shown in FIG. 2. By folding the fold line 55 of the rear side portion 17, the bottom panel 51 is parallel to the upper panel 11.

A fold line 57 is formed between the rear connecting portion 53 and the bottom panel 51. By folding the fold line 57 of the rear connecting portion 53, the rear connecting portion 53 is parallel to a side of the mutually crossed front reinforced slices 31 and 32, thereby supporting the bottom panel 51.

It is deserved to be mentioned that the present invention discloses the stereoscopic inner spacer applied to support and hold an object securely deposited within a packing carton. Further expanding, the present invention folds and crosses paper materials to form a new structural stereoscopic inner spacer and forms an open space on the stereoscopic inner spacer to support and hold components having sizes smaller than that of a packaging carton, thereby protecting the components from impact. Furthermore, the present invention further can use adhesive to reinforce the structure of the stereoscopic inner spacer, wherein the sizes and the directions of the grooves described in the application are stated as an example. The grooves of other sizes and directions can further be applied in the present invention, and the sizes and the directions of the grooves are not limited to those described in the application. Because the change of the sizes and the directions of the grooves are known by a person skilled in this art, the related details are not stated herein.

Referring to FIG. 1 and FIG. 2 simultaneously, FIG. 2 illustrates a 3-D assembly diagram showing a stereoscopic inner spacer of the present invention. The stereoscopic inner spacer 10 comprises an upper panel 11, a left side portion 13, a right side portion 15, and a rear side portion 17, wherein the upper panel 11 is further segmented to form an inserting slice 22, an inserting slice 24, an inserting slice 26, and an inserting slice 28, thereby forming an open space 30 to expose part of a bottom panel 51, such as the stereoscopic diagram shown in FIG. 2. A front reinforced slice 31 of the left side portion 13 and a front reinforced slice 32 of the right side portion 15 are connected by crossing. Additionally, the rear side portion 17 comprises the bottom panel 51, and an inserted socket 62, an inserted socket 64, an inserted socket 66, and an inserted socket 68 respectively corresponding to the inserting slice 22, the inserting slice 24, the inserting slice 26, and the inserting slice 28 are formed on the bottom panel 51, so as to plug the inserting slice 22, the inserting slice 24, the inserting slice 26, and the inserting slice 28 into the inserted socket 62, the inserted socket 64, the inserted socket 66, and the inserted socket 68 correspondingly, thereby forming an open space 30, wherein the inserting slice 22, the inserting slice 24, the inserting slice 26, and the inserting slice 28 are used to hold an object securely.

Besides the feature of providing the open space 30 to support and hold objects securely deposited within a packaging carton, another feature of the present invention is that the stereoscopic inner spacer 10 further provides a space 70, a space 75, a space 80, and a space 90 that not only provide a cushioning effect but also are used to deposit wire materials or providing other uses, wherein the wire materials are, for example, power cord or signal transmission cord, etc.

Referring to FIG. 1 and FIG. 3 simultaneously, FIG. 3 illustrates a 3-D diagram showing a stereoscopic inner spacer of the present invention deposited within a packaging carton. A packaging carton 100 comprises a lid 102 and a carton body 110, wherein the lid 102 has a connecting portion 104. The connecting portion 104 comprises a pair of side wing slices 106 that are located in two parallel sides of the connecting portion 104 and not connected to the lid 102, and an upper wing slice 108 located in one side of the connecting portion 104 is perpendicular to the sides where the side wing slices 106 are located. Two plow grooves 112 implemented on the two vertical edges of a front side of the carton body 110 are used to be plugged with the side wing slices 106 correspondingly, thereby fastening the lid 102 on the carton body 110. Another plow groove (not shown) implemented on a parallel edge of the front side of the carton body 110 is used to be plugged with the upper wing slice 108 correspondingly, thereby fastening the lid 102 on the carton body 110. The stereoscopic inner spacer 10 is deposited within the carton body 110 of the packaging carton 100, wherein the stereoscopic inner spacer 10 comprises an upper panel 11, and the upper panel 11 further includes an open space 30 formed by segmenting the upper panel 11 to form an inserting slice 22, an inserting slice 24, an inserting slice 26, and an inserting slice 28, and the open space 30 exposes part of a bottom panel 51, such as the 3-D diagram shown in FIG. 3. The open space 30 is used to deposit, for example, a computer device, a portable device (such as mobile phone or personal digital assistant, etc.) and fittings thereof.

According to the aforementioned description, one advantage of the present invention is to provide a stereoscopic inner spacer made by folding and crossing paper materials to form the new structure of stereoscopic inner spacer to support and hold objects securely deposited within a packaging carton, thereby protecting the objects from impacts. Comparing to the conventional techniques, the present invention, does not need to develop and fabricate molds thereby saving the cost of making the molds; avoids the poor impact-resistibility of the inner spacer made by folding and pasting paper sheets; and does not need to use adhesive.

Another advantage of the present invention is to provide a stereoscopic inner spacer, by folding and crossing paper materials to fabricate the stereoscopic inner spacer used to support and hold objects securely deposited within a packaging carton. The stereoscopic inner spacer of the present invention is fabricated without using adhesive, and conforms to the environmental protection standards widely adopted in Taiwan, Europe, America, Japan, and China, etc.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A stereoscopic inner spacer used to support and hold an object in a packaging carton, and the stereoscopic inner spacer comprises:

a first panel, wherein the first panel includes relatively a first side portion, a second side portion, and a third side portion, and a first fold line is formed on the borders of the first panel respectively adjacent to the first side portion, the second side portion, and the third side portion, the first panel is segmented to form a plurality of inserting slices used to form an open space, the first side portion and the second side portion are disposed on the opposite sides of the first panel, and the third side portion is disposed between the first side portion and the second side portion;

the first side portion including a first side panel, a first front reinforced slice, and a first rear reinforced slice, and the first fold line is between the first side panel and the first panel, wherein a second fold line is formed between the first front reinforced slice and the first side panel, and a first groove is implemented on the appropriate position of the first front reinforced slice; and a third fold line is formed between the first rear reinforced slice and the first side panel, and a second groove is implemented on the appropriate position of the first rear reinforced slice;

the second side portion including a second side panel, a second front reinforced slice, and a second rear reinforced slice, and the first fold line is formed between the second side panel and the first panel, wherein a second fold line is formed between the first front reinforced slice and a second side panel in the second side portion, and a third groove is implemented on the second front reinforced slice; and a third fold line is formed between the second rear reinforced slice and a second side panel in the second side portion, and a fourth groove is implemented on the second rear reinforced slice, by folding the first fold lines and the second fold lines; crossing the first groove and the second groove; and folding the third fold line and crossing the third groove and the fourth groove to form a rectangle cuboid in hollow; and the third side portion including a third side panel, a second panel, and a connecting portion, and the first fold line is formed between the third side panel and the first panel, wherein a fifth fold line is formed between the second panel and a third side panel, and a plurality of inserted sockets corresponding to the inserting slices are formed on the second panel, so as to plug the inserting slices into the inserted sockets correspondingly, thereby forming an open space; and a sixth fold line is formed between the connecting portion and the second panel.

2. The stereoscopic inner spacer according to claim 1, wherein the material of the stereoscopic inner spacer is selected from a group consisting of corrugated paper and bond paper.

3. The stereoscopic inner spacer according to claim 1, further comprises folding the first fold line of the third side panel and the fifth fold line of the second panel to make the second panel parallel to the first panel and cross the first rear reinforced slice and the second rear reinforced slice that are mutually crossed; and folding the connecting portion to make the connecting portion parallel to a side of the first front reinforced slice and the second front reinforced slice that are mutually crossed.

4. The stereoscopic inner spacer according to claim 3, wherein the first rear reinforced slice and the second rear reinforced slice that are mutually crossed are used to support the second panel.

5. The stereoscopic inner spacer according to claim 3, wherein, by folding the sixth fold line, the connecting portion is used to support the second panel.

6. The stereoscopic inner spacer according to claim 1, wherein the stereoscopic inner spacer further includes a plurality of spaces to provide a better cushioning effect.

7. A packaging apparatus used to package an object, comprises:

a packaging carton, wherein the object is deposited within the packaging carton;

a stereoscopic inner spacer corresponding to the packaging carton for supporting the object within the packaging carton, and the stereoscopic inner spacer comprises:

a first panel, wherein the first panel includes relatively a first side portion, a second side portion, and a third side portion, and a first fold line is formed on the borders of the first panel adjacent to the first side portion, the second side portion, and the third side portion, the first panel is segmented to form a plurality of inserting slices used to form an open space, the first side portion and the second side portion are disposed on the opposite sides of the first panel, and the third side portion is disposed between the first side portion and the second side portion;

the first side portion includes a first front reinforced slice and a first rear reinforced slice, wherein a second fold line is formed between the first front reinforced slice and a first side panel in the first side portion, and a first groove is implemented on the appropriate position of the first front reinforced slice; and a third fold line is formed between the first rear reinforced slice and the first side panel in the first side portion, and a second groove is implemented on the appropriate position of the first rear reinforced slice;

the second side portion including a second front reinforced slice and a second rear reinforced slice, wherein a second fold line is formed between the second front reinforced slice and the second side panel in and a third groove is implemented on the second front reinforced slice; and a third fold line is formed between the second rear reinforced slice and the second side portion, and a fourth groove is implemented on the second rear reinforced slice, by folding the first fold lines and the second fold lines; crossing the first groove and the second groove; and folding the third fold line and crossing the third groove and the fourth groove to form a hollow rectangle cuboid; and the third side portion including a second panel and a connecting portion, and the first fold line is formed between the first panel and the connecting portion, wherein a fifth fold line is formed between the second panel and a third side panel, and a plurality of inserted sockets corresponding to the inserting slices are formed on the second panel, so as to plug the inserting slices into the inserted sockets correspondingly, thereby forming an open space; and a sixth fold line is formed between the connecting portion and the second panel.

8. The packaging apparatus according to claim 7, wherein the material of the stereoscopic inner spacer is selected from a group consisting of corrugated paper and bond paper.

9. The packaging apparatus according to claim 7, further comprises folding the first fold line of the third side portion and the fifth fold line of the second panel to make the second panel parallel to the first panel and cross the first rear reinforced slice and the second rear reinforced slice that are mutually crossed; and folding the connecting portion to make the connecting portion parallel to a side of the first front reinforced slice and the second front reinforced slice that are mutually crossed.

10. The packaging apparatus according to claim 9, wherein the first rear reinforced slice and the second rear reinforced slice that are mutually crossed are used to support the second panel.

11. The packaging apparatus according to claim 9, wherein by folding the sixth fold line, the connecting portion is used to support the second panel.

12. The packaging apparatus according to claim 7, wherein the stereoscopic inner spacer further includes a plurality of spaces to provide a better cushioning effect.

* * * * *